US006866287B1

(12) United States Patent
Dat

(10) Patent No.: US 6,866,287 B1
(45) Date of Patent: Mar. 15, 2005

(54) SNOWBOARD SHOE FIXING SYSTEM

(76) Inventor: Frédéric Dat, Chemin du Romarin, F-11110 Salles d'Aude (FR)

( * ) Notice: Subject to any disclaimer, the term of this patent is extended or adjusted under 35 U.S.C. 154(b) by 0 days.

(21) Appl. No.: 09/913,862

(22) PCT Filed: Feb. 16, 2000

(86) PCT No.: PCT/FR00/00380

§ 371 (c)(1),
(2), (4) Date: Aug. 20, 2001

(87) PCT Pub. No.: WO00/48694

PCT Pub. Date: Aug. 24, 2000

(30) Foreign Application Priority Data

Feb. 19, 1999 (FR) ..... 99 02144

(51) Int. Cl.[7] ..... A63C 9/00
(52) U.S. Cl. ..... 280/623; 280/11.36; 280/14.22
(58) Field of Search ..... 280/607, 613, 280/618, 619, 620, 623, 624, 633, 634, 14.21, 14.22, 11.36, 11.31; 36/117.7, 117.8, 118.1

(56) References Cited

U.S. PATENT DOCUMENTS 3,145,028 A * 8/1964 Cubberley ..... 280/620
5,899,483 A * 5/1999 Paris ..... 280/611
5,947,507 A * 9/1999 Quintana et al. ..... 280/615
5,997,027 A * 12/1999 Jungkind ..... 280/617
6,003,893 A * 12/1999 Hansen ..... 280/624
6,007,077 A * 12/1999 Moe ..... 280/14.22
6,056,312 A * 5/2000 Hogstedt ..... 280/624
6,105,993 A * 8/2000 Gignoux ..... 280/613
6,116,634 A * 9/2000 Mometti ..... 280/613
6,267,403 B1 * 7/2001 Bossin et al. ..... 280/625
6,406,040 B1 * 6/2002 Thorne ..... 280/14.21
6,443,465 B1 * 9/2002 Maravetz et al. ..... 280/14.22

FOREIGN PATENT DOCUMENTS

| | | |
|---|---|---|
| DE | 196 02 667 C1 | 10/1997 |
| FR | 2 592 807 | 7/1987 |
| FR | 2 760 373 | 9/1998 |

* cited by examiner

*Primary Examiner*—Christopher P. Ellis
*Assistant Examiner*—Christopher Bottorff
(74) *Attorney, Agent, or Firm*—Young & Thompson

(57) ABSTRACT

A quick-fit system of a shoe on a snowboard where the hell-piece also serves as locking detents and unlocking cam for the system maintaining the shoe in its fixing element. The heel-piece is divided in its lower part into two branches each interlocked to a wing of the base by a pin. The lower part of the branches are urged to be housed in a notch with matching shape, located on the shoe or heel support linked thereto.

18 Claims, 4 Drawing Sheets

SNOWBOARD SHOE FIXING SYSTEM

BACKGROUND OF THE INVENTION

The invention relates to a system for fixing a shoe to a snowboard, in particular a quick-fit system comprising a heel release, also called a spoiler, and a heel-piece described in my patent FRA 2,760,373.

DESCRIPTION OF THE RELATED ART

Existing systems have a relatively high number of additional parts compared with standard fixing systems with locking catches, springs acting on the latter and cams unlocking the assembly and, on the other hand, located at the bottom of the fixing systems, they are difficult to reach.

SUMMARY OF THE INVENTION

A purpose of the present invention is to simplify this by also equipping the heel release with functions of locking catches and of cams unlocking the system.

The fixing system comprises a base with a transversal section in a "U" shape equipped with a sole fixed flat on the snowboard, two wings extending up the sides of the sole, a heel release, a vertical part holding the rear of the shoe, placed transversally at the rear of the base, dividing in its lower part into two branches each interlocked to a wing of the base by means of a pin, each branch extending on the other side of the pin, descending towards the base. A lower part of the branches of the heel release located under each pin is housed under pressure from springs above part of the shoe or a heel-piece linked to the latter, located on the sides of the shoe, on each side of the heel, which parts may for example be in the form of catches engaging in notches of matching shape, preventing the shoe from coming out of the fixing system. The spring, having an angular action, surrounds the pin, one end pressing on the base, the other end, in contact with the heel release, causes the part of the latter which is located beneath the pin to pivot towards the front of the fixing system. The unlocking of the shoe or its heel-piece is achieved by pushing the top of the heel release towards the front of the fixing system.

Stops on the base in contact with the shoe or the heel-piece prevent said shoe from slipping towards the front and the rear of the fixing system.

In order to avoid accidental pivoting of the heel release on impact, a mobile blade, linked by one of its ends to the heel release, forms a loop behind said heel release, the other end of this blade is free and passes through an opening made in the heel release through the latter, and comes into contact with the rear of the shoe. In the event of an impact at the rear of the fixing system, the blade therefore comes to rest against the shoe, not the heel release.

Another safety feature consists of dividing the heel release into two parts; the lower part which holds the shoe or its heel-piece and the upper part on which the shoe rests. This upper part has two oblong holes in its base, substantially vertical, through which two pins pass which connect it to the lower part, offering partial freedom in rotation and in vertical translation of the upper part with respect to the lower part. The base of the upper part also comprises at least one element located beneath an element in a shape which matches the lower part, at a distance substantially equal to that covered by the pins in the oblong holes, which elements press and fit together when the upper part is lifted by the user, only then joining the two parts of the heel release in rotation. A return spring linking the two parts helps the upper part to return to the normal position of use when released. To open the fixing system, two movements are therefore necessary: the top of the heel release must be raised and pushed forward.

According to another embodiment, the lower part of the heel release, in the shape of a bow, holding the heel-piece, has on its rear an element, a handle, which is easy to hold and which, by pulling upwards, allows the rotation of the lower part and therefore the releasing of the heel-piece.

The front part of the shoe intended for this fixing system has on the sides of its sole two flat parts which slide into two housings of matching shape which pivot about pins connecting them to the front of the wings of the base.

DESCRIPTION OF THE PREFERRED EMBODIMENTS

Figure 1:
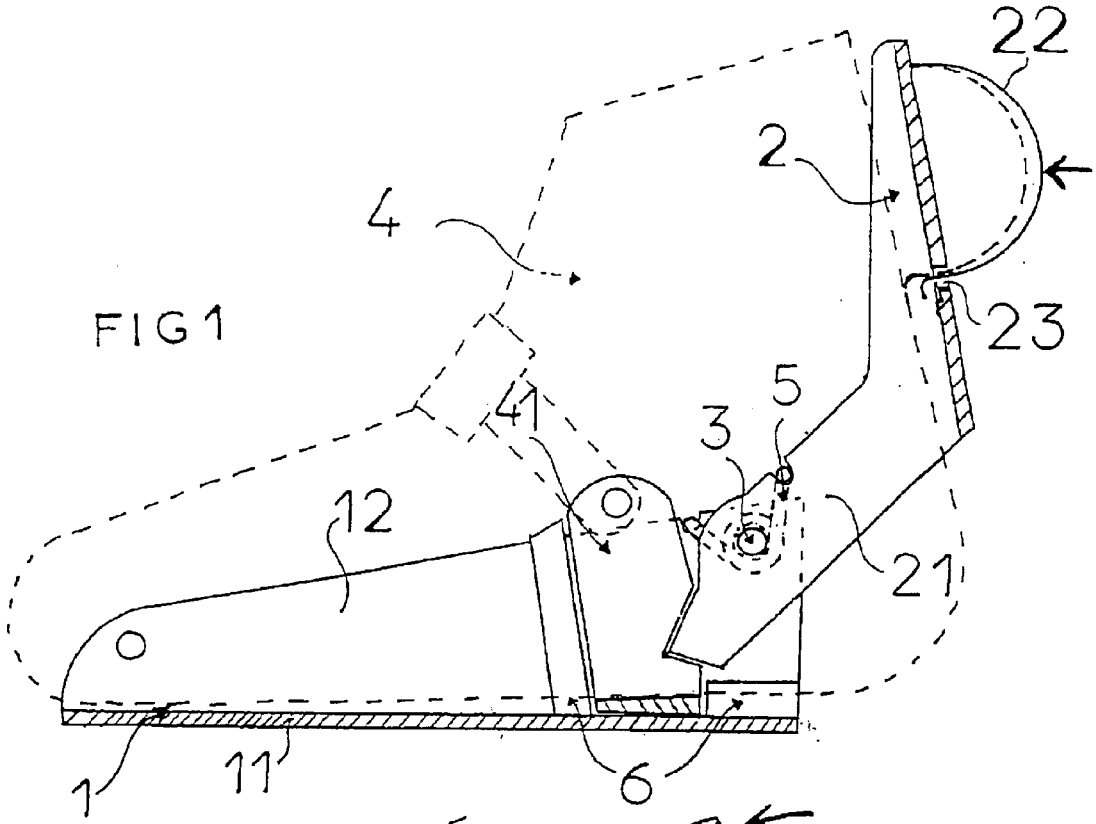
FIGS. 1 and 2 show a longitudinal section of a fixing system and its shoe holding system according to the invention.
Figure 2:
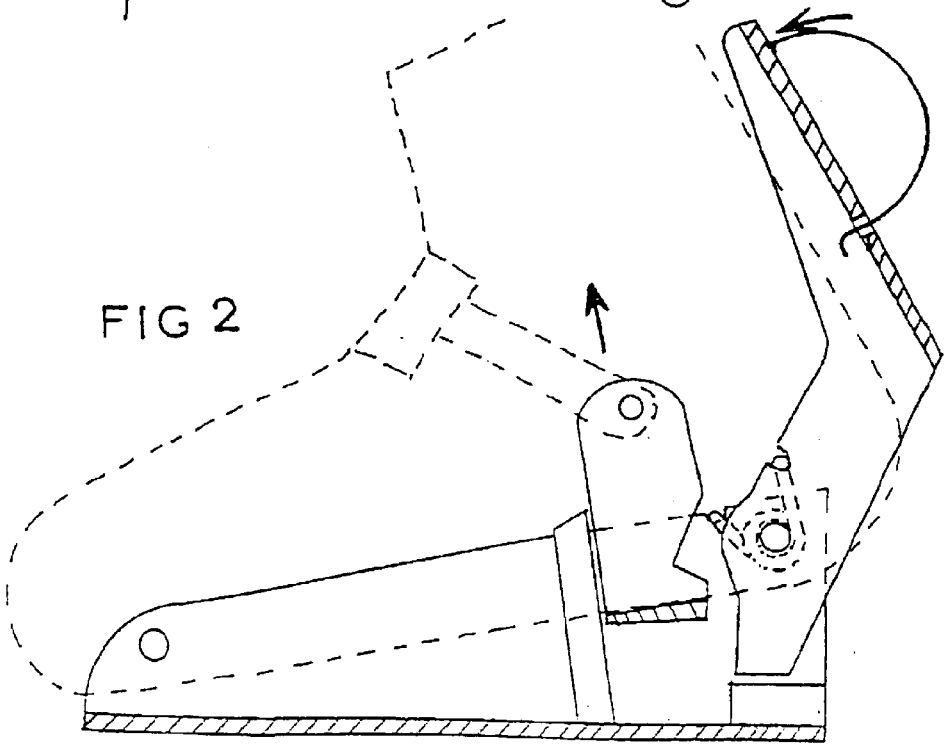
Figure 3:
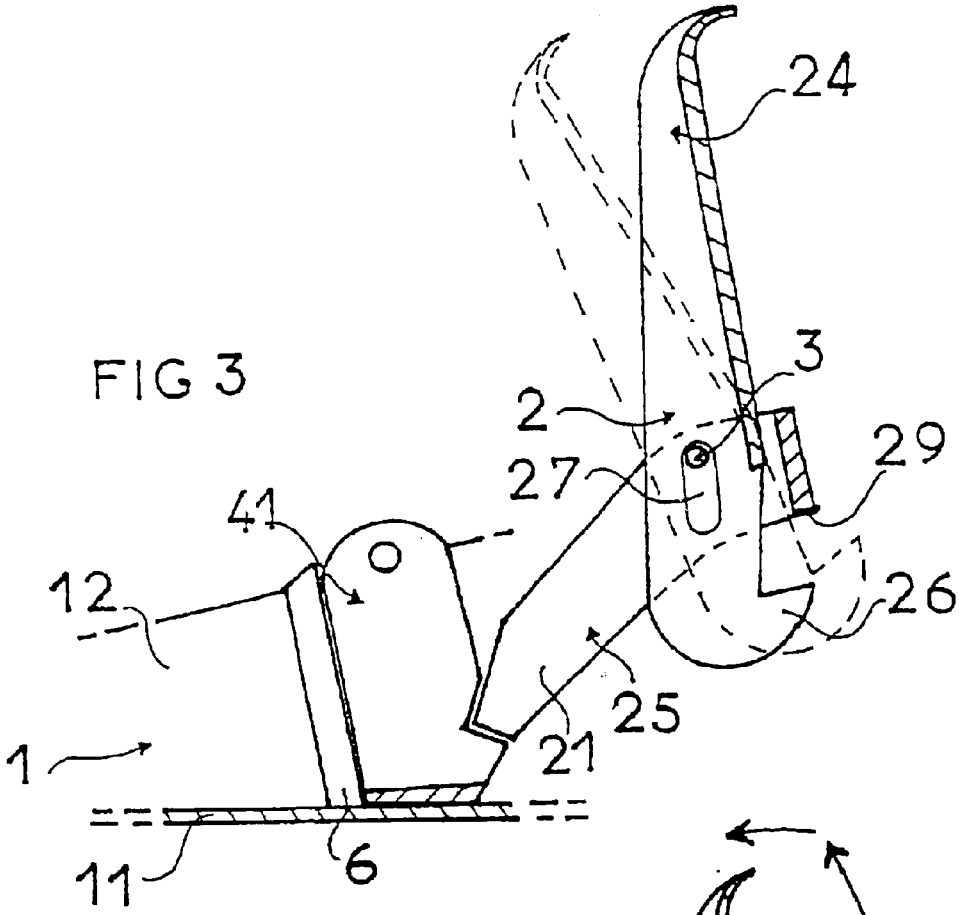
FIGS. 3, 4 and 5 represent sections of a heel release in two parts.
Figure 4:
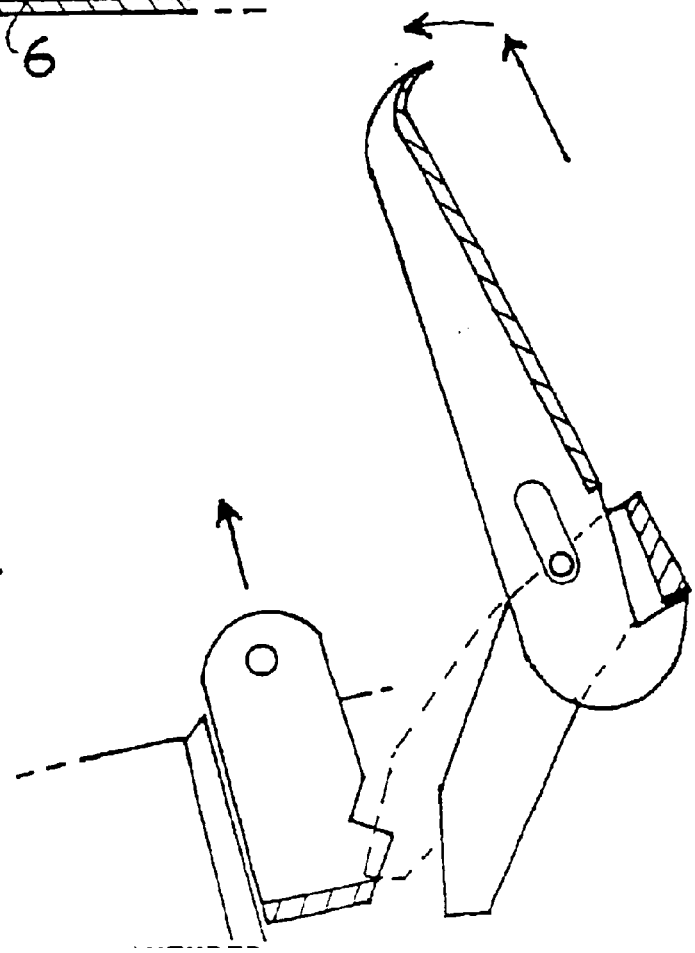
Figure 5:
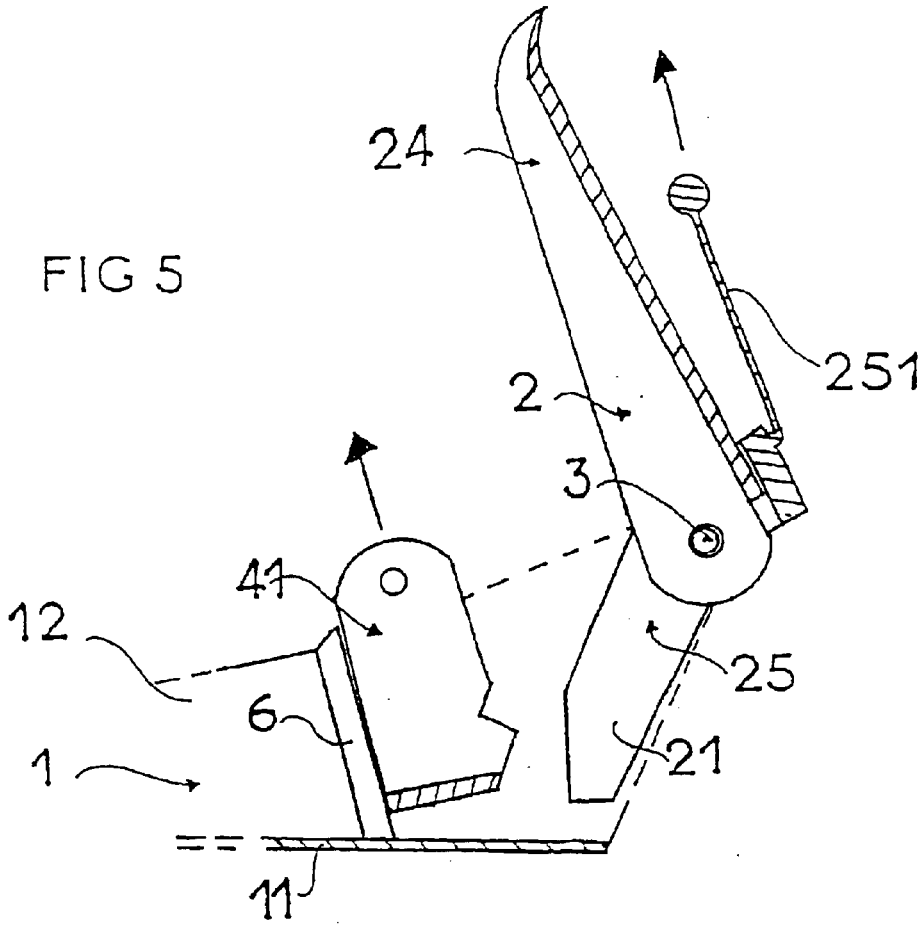

With reference to these figures, the fixing system is constituted by a base (1) comprising a sole (11) fixed flat on the snowboard and two wings (12) extending up the sides of this sole (11), a heel release (2) placed transversally at the rear of the base (1), dividing in its lower part into two branches (21) each interlocked to a wing (12) by means of a pin (3). The lower part of these branches (21) is housed in a notch of a shape matching the latter cut into the extensions (41) of a heel-piece linked to the shoe (4) located on the sides of the latter, on either side of its heel. A spring (5) having an angular action surrounds the pin (3), one of its ends fits into a groove located on the top of the wing (12) of the base (1), the other end in a groove located on the heel release (2) above the pin (3) causes the heel release (2) to pivot about the latter.

Two stops (6) formed by additional thicknesses of the wing (12) located in front of and behind the extension (41) prevent the shoe from sliding in its fixing system. A flexible blade (22) is fixed on top of the heel release (2) by one of its ends; the other, passing through an opening (23) in the heel release (2) comes to rest against the back of the shoe (4).

According to other variations, the heel release (2) is divided into an upper part (24) and a lower part (25). The upper part (24) is divided at its base into two branches in the form of hooks (26) with two oblong holes (27) through which the pins (3) pass connecting the upper parts (24), lower parts (25) and the wings (12) of the base (1). The lower part (25) has two flat parts (29) in shapes matching those of the hooks (26) and located above the latter.

A handle (251) is fixed behind the lower part (25).

Figure 6:
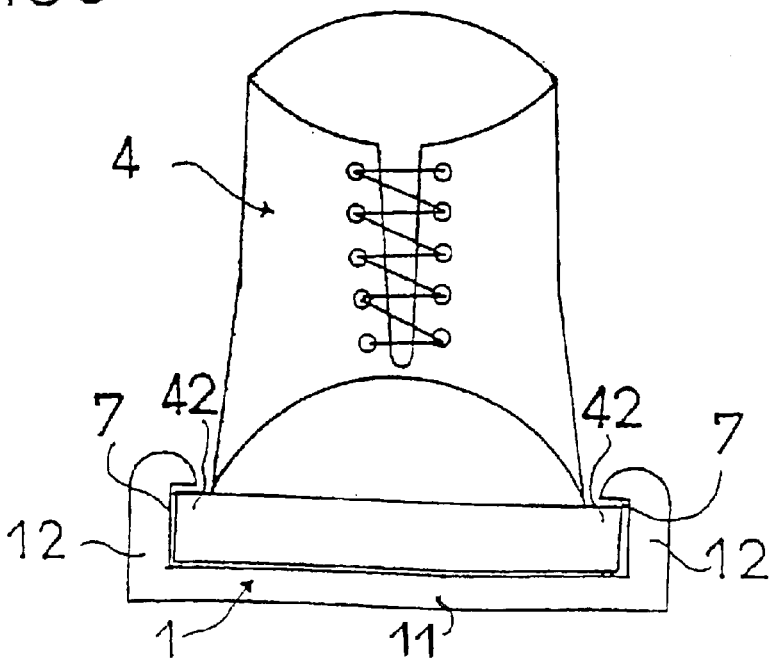
FIGS. 6 and 7 show flat parts discussed below.
Figure 7:
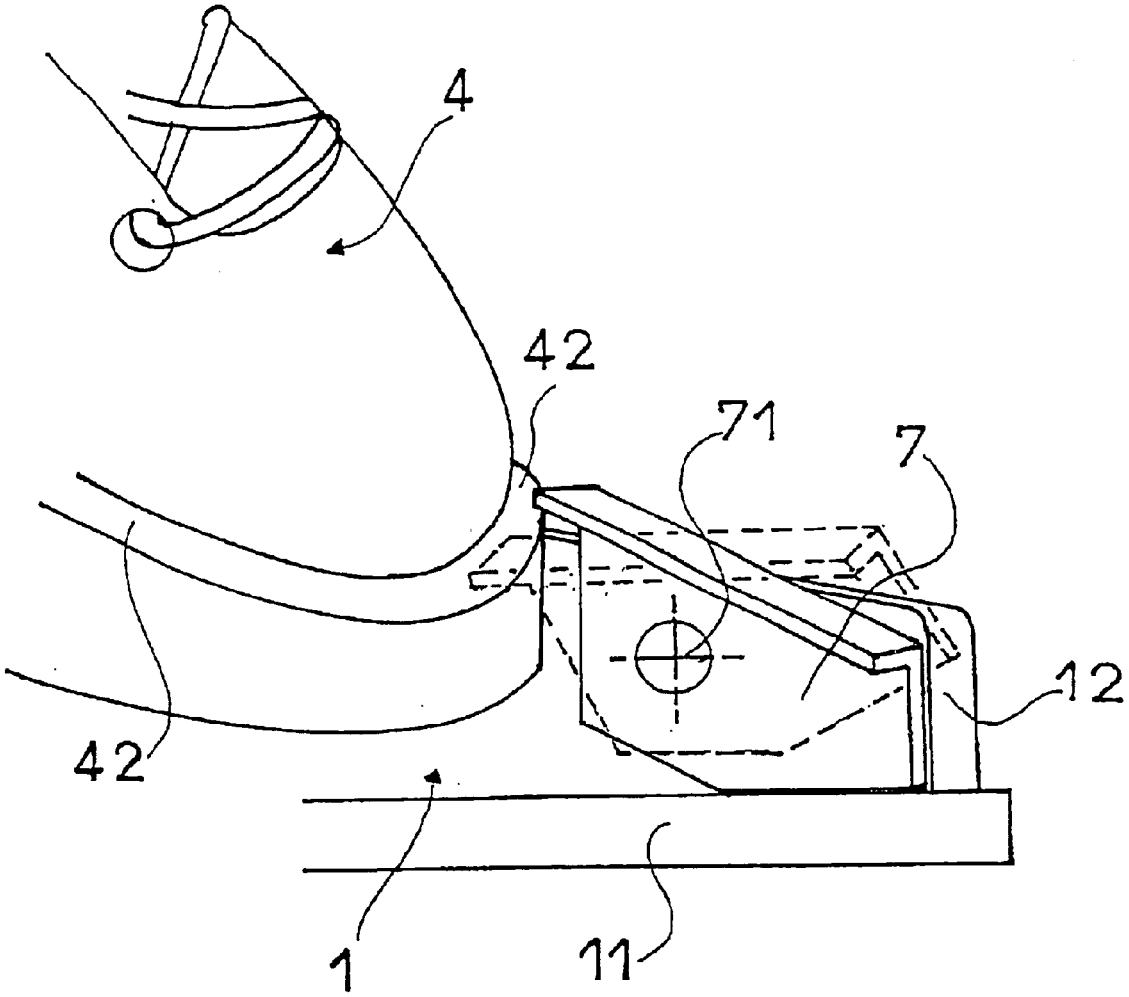

Two flat parts (42), located on either side of the shoe (4) at the front, moulded with the sole, slipping under angles (7) linked by pins (71) to the wings (12) (FIGS. 6 and 7).

What is claimed is:

1. Fixing system for fixing a shoe to a snowboard, said system comprising:

a base for receiving said shoe, said base comprising a sole to be fixed flat on said snowboard; and two lateral wings extending up on the sides of said sole corresponding to the two lateral sides of said shoe;

a heel release comprising an upper part extending vertically to maintain the rear of said shoe, placed transversally at the rear of said base, and two lateral branches provided in the lower part, each lateral branch being interlocked to one of said two lateral wings of said base by a pin, said heel release being mounted pivotally on said pin under action of a spring enabling said upper part of said heel release to bear against the rear of said shoe; and a heel piece to be fixed removably to said shoe and comprising two side extensions to be located on each lateral side of the shoe, each said side extension being engaged removably between two stop means provided on each of said two lateral base wings to prevent said heel piece from sliding along said base, wherein, when the heel piece is locked into a normal position in the base, each lateral branch has a lower part located under said pin that is housed under the action of said spring above one part of said side extension of said heel piece, to lock said lower part to said one part of said heel piece and to fix said shoe in said base, said one part of said side extension is one of a catch and a notch and said lower part of said each branch is another of the catch and the notch, the catch and the notch cooperating together to lock said notch to said catch and to fix said shoe in said base.

2. The fixing system according to claim 1, wherein said lower part of each branch is in the form of the catch and the part of said side extension is in the form of the corresponding notch.

3. The fixing system according to claim 1, wherein each said spring is an angular action spring surrounding the corresponding pin, one end of said spring pressing on said base and the other end being in contact with the corresponding lateral branch of the heel release in order to cause said lower part of said branch to pivot towards the front of said fixing system.

4. The fixing system according to claim 1, wherein said stop means are formed by additional thicknesses of the wings located in front of and behind said side extensions.

5. The fixing system according to claim 1, further comprising a mobile blade forming a loop behind the back part of the heel release, having one end linked to the back part of the heel release, the other end being free, passing through an opening made in said back part and coming into contact with the rear of the shoe.

6. Fixing system according to claim 1, wherein the upper part and lateral branches of the heel release are distinct parts, said back part having a base part with two substantially vertical oblong holes, each said oblong hole cooperating with one of said pins, said base part having under each said oblong holes an element that is located under an element of matching shape provided on the corresponding lateral branch at a distance substantially equal to the distance covered by said pins in said oblong holes, said corresponding elements pressing and fitting together when said upper part of the heel release is lifted by the user so as to join together said upper part and said lateral branches of said heel release and permits the rotation of said branches.

7. Fixing system according to claim 6, wherein each element on the base part of the upper part of said heel release is in the form of a hook, the corresponding element of each lateral branch being a flat part.

8. Fixing system according to claim 1, wherein the upper part of said heel release has on its rear a prehension handle.

9. Fixing system according to claim 1, further comprising a shoe having on both lateral sides of its sole one flat part adapted to slide into one housing of corresponding shape provided on the front of the corresponding wing of said fixing system base.

10. Fixing system according to claim 9, wherein each said housing pivots about a pin connecting it to the corresponding wing of said fixing system base.

11. Fixing system for fixing a shoe to a snowboard, said system comprising:

a base for receiving said shoe comprising a sole to be fixed on said snowboard; and two lateral wings extending up on the sides of said sole corresponding to the two lateral sides of said shoe;

a heel release comprising an upper part extending vertically to maintain the rear of said shoe, placed transversally at the rear of said base, and two lateral branches provided in the lower part, each lateral branch being interlocked to one of said two lateral wings of said base by a pin, said heel release being mounted pivotally on said pin under action of a spring enabling said upper part of said heel release to bear against the rear of said shoe; and a heel piece fixed removably to said shoe, said heel piece comprising lateral side extensions, each of which lateral side extensions being engaged removably between two stop means provided on each of said two lateral base wings to prevent said shoe from sliding along said base, wherein, when the shoe is locked into a normal position in the base, each lateral branch has a lower part located under said pin that is housed under the action of said spring above one part of said side part of said shoe, to lock said lower part to said one part of said heel piece and to fix said shoe in said base, said one part of said side extension is one of a catch and a notch and said lower part of said each branch is another of the catch and the notch, the catch and the notch cooperating together to lock said catch to said notch and to fix said shoe in said base.

12. Fixing system according to claim 11, wherein said shoe has on both lateral sides of its sole one flat part adapted to slide into one housing of corresponding shape provided on the front of the corresponding wing of said fixing system base.

13. The fixing system according to claim 11, wherein said lower part of each branch is in the form of the catch and the part of said side extension is in the form of the corresponding notch.

14. The fixing system according to claim 11, wherein each said spring is an angular action spring surrounding the corresponding pin, one end of said spring pressing on said base and the other end being in contact with the corresponding lateral branch of the heel release in order to cause said lower part of said branch to pivot towards the front of said fixing system.

15. The fixing system according to claim 11, wherein said stop means are formed by additional thicknesses of the wings located in front of and behind said side extensions.

16. The fixing system according to claim 11, further comprising a mobile blade forming a loop behind the back part of the heel release, having one end linked to the back part of the heel release, the other end being free, passing through an opening made in said back part and coming into contact with the rear of the shoe.

17. Fixing system according to claim 11, wherein the upper part and lateral branches of the heel release are distinct parts, said back part having a base part with two substantially vertical oblong holes, each said oblong hole cooperating with one of said pins, said base part having under each said oblong holes an element that is located under an element of matching shape provided on the corresponding lateral branch at a distance substantially equal to the distance covered by said pins in said oblong holes, said corresponding elements pressing and fitting together when said upper part of the heel release is lifted by the user so as to join together said upper part of said lateral branches of said heel release and permits the rotation of said branches.

18. Fixing system according to claim 11, wherein each element on the base part of the upper part of said heel release is in the form of a hook, the corresponding element of each lateral branch being a flat part.

* * * * *